US005368452A

United States Patent [19]

Johnson et al.

[11] Patent Number: 5,368,452

[45] Date of Patent: Nov. 29, 1994

[54] DOUBLE DIAPHRAGM PUMP HAVING TWO-STAGE AIR VALVE ACTUATOR

[75] Inventors: Harold Johnson, Buffalo; Daniel J. Kvinge, Shoreview; Steven P. Plager, Burnsville; Richard D. Zarneke, Moundsview, all of Minn.

[73] Assignee: Graco Inc., Golden Valley, Minn.

[21] Appl. No.: 95,092

[22] Filed: Jul. 20, 1993

[51] Int. Cl.[5] ..... F04B 43/06

[52] U.S. Cl. ..... 417/395; 137/338; 91/313

[58] Field of Search ..... 417/393, 395; 137/338, 137/339; 91/313

[56] References Cited

U.S. PATENT DOCUMENTS

| | | | |
|---|---|---|---|
| 274,247 | 3/1883 | Allison et al. . | |
| 325,900 | 9/1885 | Bartlett . | |
| 400,787 | 4/1889 | Parker . | |
| 2,679,209 | 5/1954 | Fischer et al. . | |
| 3,791,768 | 2/1974 | Wanner . | |
| 3,838,946 | 10/1974 | Schall . | |
| 4,386,888 | 6/1983 | Verley . | |
| 4,494,574 | 1/1985 | Casilli et al. | 417/393 |
| 4,548,551 | 10/1985 | Ruttenberg et al. . | |
| 4,708,601 | 11/1987 | Bazan et al. . | |
| 4,767,282 | 8/1988 | Igarashi et al. . | |
| 4,854,832 | 8/1989 | Gardner et al. . | |
| 4,895,494 | 1/1990 | Gardner | 417/393 |
| 5,277,099 | 1/1994 | Powers | 437/338 |
| 5,277,555 | 1/1994 | Robinson | 417/393 |

*Primary Examiner*—Richard A. Bertsch
*Assistant Examiner*—M. Kocharov
*Attorney, Agent, or Firm*—Palmatier, Sjoquist & Helget

[57] ABSTRACT

A double diaphragm pump operated by selectively switching pressurized air into either of two diaphragm chambers; the air actuator valve is a cup valve which is slidable over orifices in a valve plate, and actuable by air pistons; the air pistons are coupled via passageways to a pilot valve which is a second cup valve slidable over orifices in a valve plate, the cup valve being actuable by pins extending into the diaphragm chambers and into contact with diaphragm members at predetermined positions.

10 Claims, 5 Drawing Sheets

DOUBLE DIAPHRAGM PUMP HAVING TWO-STAGE AIR VALVE ACTUATOR

BACKGROUND OF THE INVENTION

The present invention relates to a diaphragm pumping apparatus; more particularly, the invention relates to a double diaphragm pump having a two-stage air valve actuator for regulating the pumping action.

Double diaphragm pumps are well known in the art, wherein a source of pressurized-air is selectively applied into each of two diaphragm chambers to thereby cause deflection of the respective diaphragms to create a pumping action against liquid materials which are introduced into the diaphragm chamber. Each diaphragm effectively isolates the chamber into two halves, a first half which is susceptible to varying air pressures and a second half which is exposed to the liquid materials being pumped.

The delivery of pressurized air to a double diaphragm pump is typically controlled by an air valve, and the air valve is typically actuated by a mechanical linkage to the diaphragms. Therefore, deflection of one diaphragm causes the actuator to toggle the air valve so as to introduce pressurized air into the diaphragm chamber, which then causes deflection of the second diaphragm until the mechanical actuator toggles the air valve in the reverse direction. This reciprocating movement of the respective diaphragms continues for so long as the pressurized inlet air exceeds the pressure of the liquids confined in the delivery portion of the diaphragm chambers. When the liquid and air pressures equalize, the diaphragms no longer cycle and the pump undergoes what is referred to as a stall condition. This stall condition exists until a pressure imbalance occurs, and the air pressure driving force against the diaphragm again causes diaphragm movement. The valve actuator which controls the flow of pressurized air into the diaphragm chambers is typically mechanically linked to the diaphragms themselves, so as to become actuated at predetermined positions of the diaphragm. In some cases, double diaphragm pumps have utilized a pilot valve mechanically linked to the diaphragm, which then directs the flow of pressurized air to an actuator valve, and the actuator valve directs the flow of pressurized air to the diaphragm chamber. Various types of spool valves have been utilized for either or both of these valving functions.

The actuator valve which functions to direct the flow of pressurized air into a diaphragm chamber usually simultaneously exhausts the pressurized air from the other diaphragm chamber. The air exhausting through the valve actuator undergoes rapid and sudden decompression, causing a dramatic drop in temperature in the proximity of the valve actuator. Repeated exhaust cycles, particularly when the pressurized air has significant moisture content, results in frost buildup proximate the actuator valve and in the exhaust chamber. This frost buildup can accumulate and create an icing effect, which in the extreme can block the further physical movement of the actuator valve and thereby disable the pumping system.

Another problem with prior art double diaphragm pumps relates to the inefficiencies caused by wear of the valve actuators. Valve actuators typically cycle at rates up to several hundred times per minute during the lifetime of the pump, and as these actuators gradually wear, the air seals associated with the actuators undergo leakage which degrades the pressurized operation of the pump. This can eventually lead to pump failure when the leakage condition becomes so excessive as to no longer permit the actuators to operate effectively.

SUMMARY OF THE INVENTION

The invention comprises a double diaphragm pump having a pilot valve and an actuator valve consisting of valve cups which are slidably moved over a hardened metal plate. The metal plate contains six air ports, three of which are used to route pressurized air and exhaust between the pilot valve and the actuator valve, and three of which are used to route pressurized air and exhaust air between the diaphragm chambers and the actuator valve. The actuator slide valve has a heat exchanger member which is exposed to incoming pressurized warm air, and has a valve cup which is exposed to the decompression and cooling effects of exhaust air; the heat exchanger absorbs heat from the incoming warm air to prevent frost buildup in the actuator and exhaust port area.

It is a principal object and advantage of the present invention to provide an air valve actuator and pilot valve for a double diaphragm pump, having a self-sealing design and a heat exchanger for temperature control.

It is another object and advantage of the present invention to provide a pilot valve and actuator valve for a double diaphragm pump wherein both valves constitute sliders over a hardened metal plate.

It is a further object and advantage of the present invention to provide a self sealing actuator valve for a double diaphragm pump which is constructed of a relatively few number of parts and is accessible for maintenance without entirely disassembling the pump.

It is another object and advantage of the present invention to provide an outer air chamber which substantially surrounds the exhaust chamber to utilize relatively warmer inlet air to control the temperature of the relatively colder exhaust air.

Other and further objects and advantages will become apparent from the following specification and claims and with reference to the appended drawings.

DESCRIPTION OF THE PREFERRED EMBODIMENT

Figure 2:
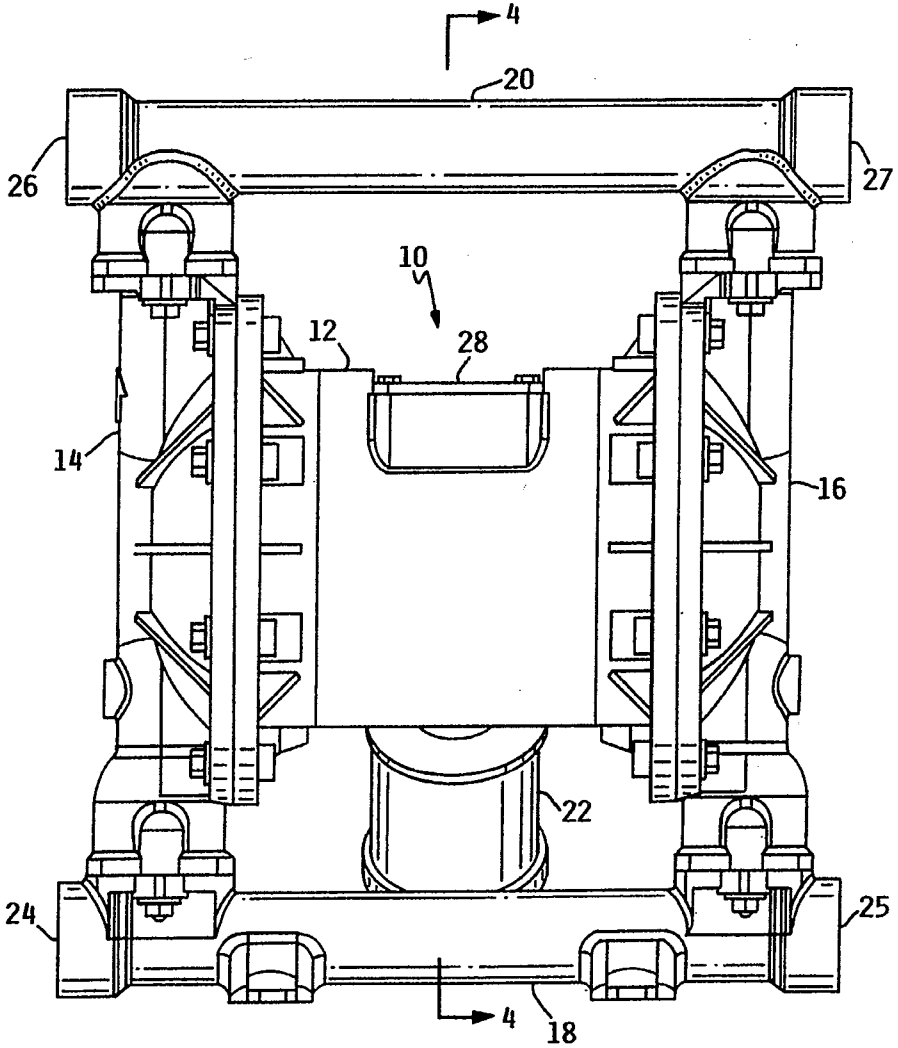
FIG. 2 shows a side elevation view of the pump.
Figure 1:
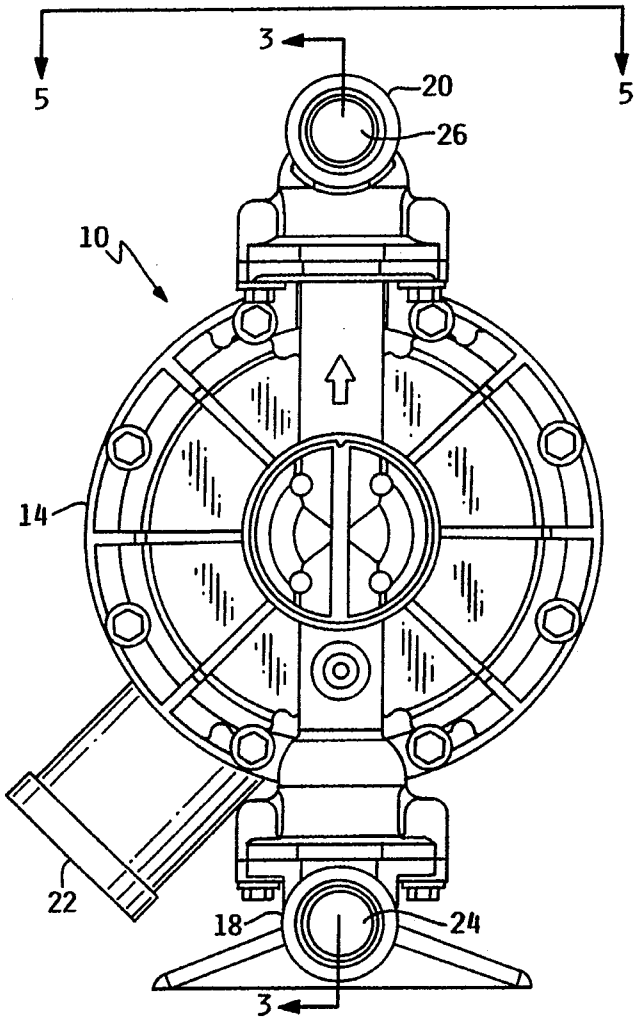
FIG. 1 shows an end elevation view of the pump of this invention.

Referring first to FIGS. 1 and 2, several elevation views of the invention are shown. A double diaphragm pump 10 has a pump housing 12 to which are affixed a pair of diaphragm covers 14, 16. A liquid inlet manifold 18 is also affixed to housing 12, as is a liquid delivery manifold 20. An air exhaust muffler 22 is removably attached to housing 12. The liquid to be pumped by pump 10 is coupled to either or both of inlets 24, 25, and the pumped liquid delivered by pump 10 is expelled via outlets 26, 27. An actuator valve assembly, to be more fully described hereinafter, is accessible through a removable cover plate 28.

Figure 3:
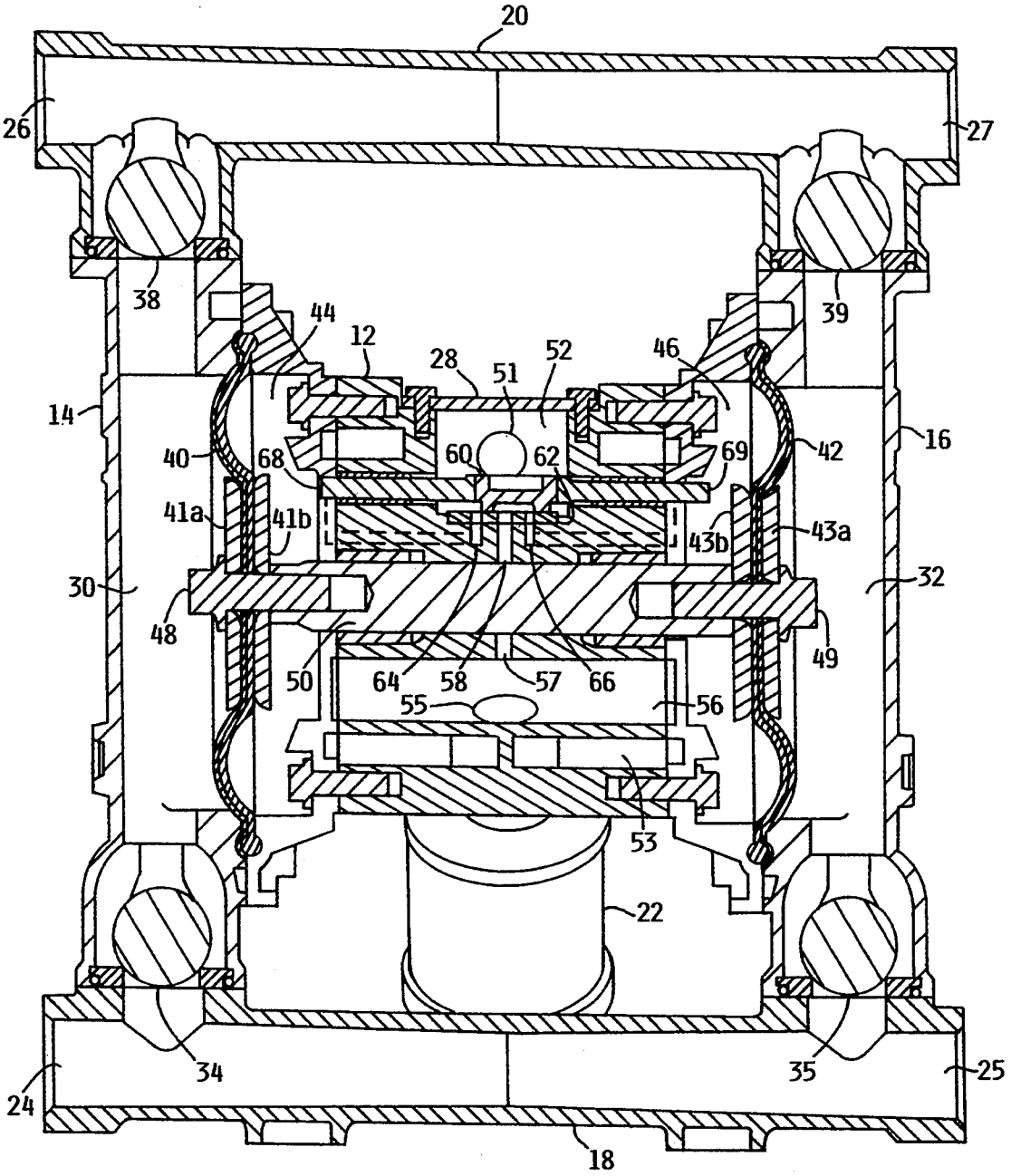
FIG. 3 shows a cross-sectional view taken along the lines 3—3 of FIG. 1.

FIG. 3 shows a cross-section view of pump 10 taken along the lines 3—3 of FIG. 1. First and second diaphragm chambers 30, 32 are respectively formed in diaphragm covers 14, 16. Inlet manifold 18 is coupled to diaphragm chambers 30, 32 via inlet ball checks 34, 35. Delivery manifold 20 is coupled to diaphragm chambers 30, 32 via outlet ball checks 38, 39. A diaphragm 40 is clamped between cover 14 and housing 12 thereby isolating diaphragm chamber 30 from diaphragm air chamber 44. A diaphragm 42 is clamped between cover plate 16 and housing 12 to thereby isolate diaphragm chamber 32 from diaphragm air chamber 46. The center portion of diaphragm 40 is clamped between two plates 41*a*, 41*b*, and the plates are affixed to a diaphragm connecting rod 50 by a fastener 48. The center portion of diaphragm 42 is clamped between two plates 43*a*, 43*b*, and the plates are affixed to diaphragm connecting rod 50 by fastener 49. Connecting rod 50 interconnects the two diaphragms 40, 42, and thereby causes the diaphragms to move in coincidence. Connecting rod 50 is slidably movable within a central opening through housing 12, there being sufficient clearance between connecting rod 50 and the central opening to permit the passage of air therebetween.

An actuator chamber 52 is coupled to an air inlet 51, for receiving a source of pressurized air. Air exhaust muffler 22 is coupled to an air outlet 55, which opens into an exhaust chamber 56. An exhaust passage 57 also opens into exhaust chamber 56, and exhaust passage 57 is in flow communication with exhaust passage 58 via the clearance between connecting rod 50 and the opening through housing 12. Pilot valve 60 controls the air flow communication into passage 58 by virtue of its slidable position on valve plate 62. Valve plate 62 has three ports passing therethrough, the center port being aligned with passage 58. The two outside ports through valve plate 62 are coupled to passages 64, 66. The lower surface of pilot valve 60 is formed into a cup shape, and is referred to as a valve cup. The size of the valve cup is sufficient to permit air flow between any two ports lying beneath the valve cup. In the position shown in FIG. 3, pilot valve 60 is positioned to align its underside valve cup in flow communication between passages 66 and 58, thereby providing an exhaust flow connection to exhaust chamber 56. In its alternate position, the valve cup in slide valve 60 provides a flow communication path between passage 64 and passage 58, thereby providing an exhaust flow communication to exhaust chamber 56.

Pilot valve 60 is connected to actuator pins 68, 69, which are respectively horizontally slidable through passages which lead to diaphragm air chambers 44, 46. Actuator pin 68 connects pilot valve 60 into diaphragm air chamber 44, and actuator pin 69 connects pilot valve 60 into diaphragm air chamber 46. The respective ends of actuator pins 68, 69 may be contacted by plates 41*b*, 43*b*, which plates respectively slide the actuator pins horizontally and thereby slide pilot valve horizontally in coincidence. In the view shown in FIG. 3, actuator pin 69 projects into diaphragm air chamber 46, and therefore is positioned for contact by plate 43*b* whenever diaphragm 42 moves leftwardly. The corresponding leftward movement of actuator pin 69 will slide the entire assembly consisting of actuator pin 69, pilot valve 60, and actuator pin 68, thereby causing the end of actuator pin 68 to project into diaphragm air chamber 44.

Figure 4:
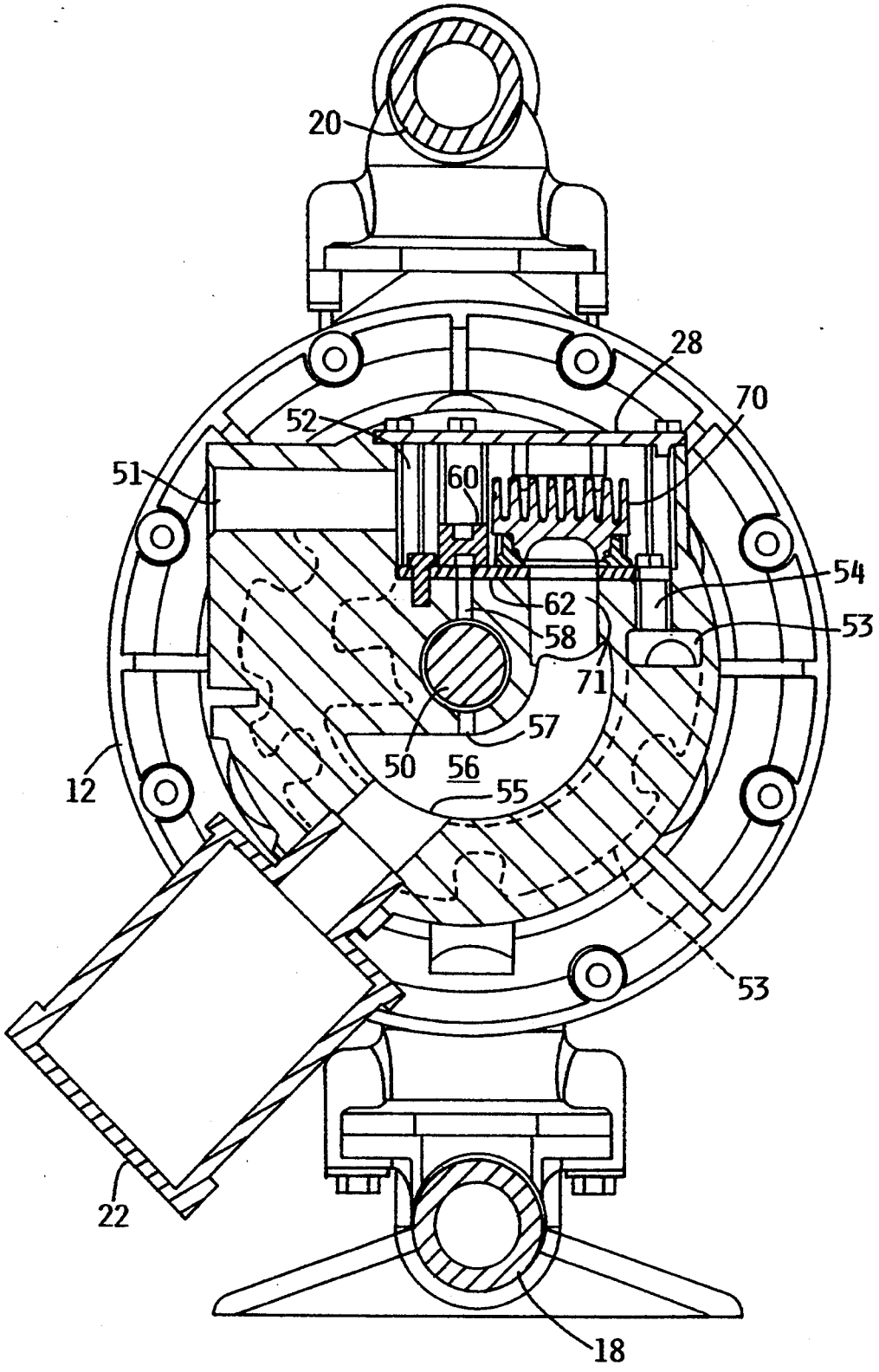
FIG. 4 shows a cross-sectional view taken along the lines 4—4 of FIG. 2.

FIG. 4 shows a cross-section view taken along the lines 4—4 of FIG. 2. In this view, the exhaust passages are fully visible between air exhaust muffler 22 and pilot valve 60 and actuator valve 70. For example, the exhaust passages associated with pilot valve 60 include passage 58, the clearance around connecting rod 50, passage 57, exhaust chamber 56, and air outlet 55. The exhaust passage 71 from actuator valve 70 is coupled directly into exhaust chamber 56. An outer chamber 53 may be formed in the pump housing 12 in a manner which is shown in dotted outline in FIG. 4. Further, an air passage 54 may be formed between outer chamber 53 and inlet air chamber 52, thereby permitting the relatively warm inlet air to circulate freely throughout outer chamber 53. Outer chamber 53 substantially surrounds the exhaust chamber 56, and the circulation of the relatively warmer inlet air into outer chamber 53 tends to warm the exhaust chamber 56. This warming process reduces the buildup of frost within exhaust chamber 56, and also reduces condensation caused by the passage of the relatively colder exhaust air through the air outlet 55.

Figure 6:
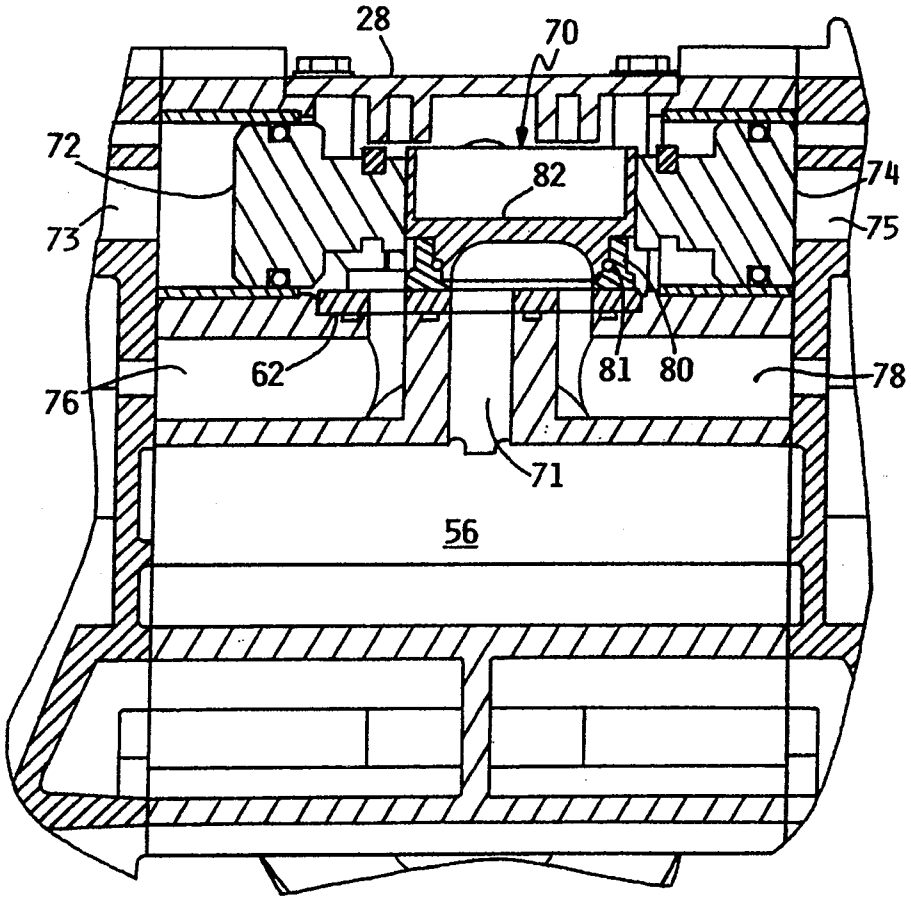
FIG. 6 shows a cross-sectional view taken along the lines 6—6 of FIG. 5.
Figure 5:
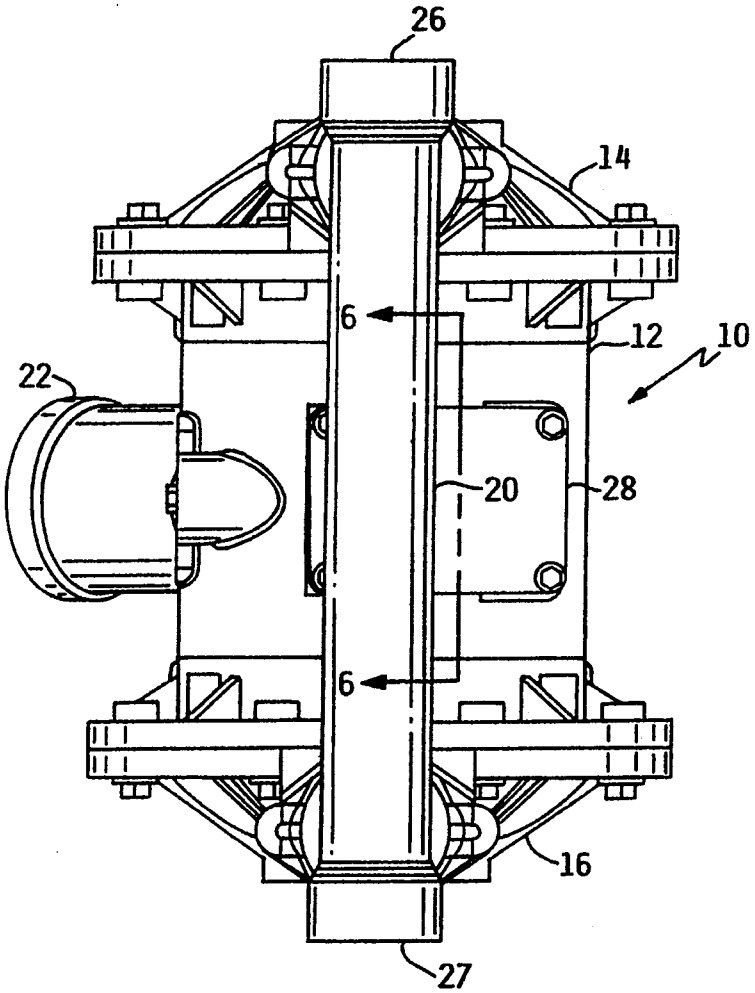
FIG. 5 shows a top view of the pump taken along the lines 5—5 of FIG. 1.

FIG. 5 shows a top view of pump 10 taken along the lines 5—5 of FIG. 1. In this view, the removably cover plate 28 is clearly visible. FIG. 6 shows a cross-section view taken along the line 6—6 of FIG. 5, illustrating a cross-section view of actuator valve 70. Actuator valve 70 is connected to a pair of slidable piston members 72, 74, which are respectively slidable within cylinder housings. Piston 72 is in flow communication with the pilot valve passage 64 via passage 73; piston 74 is in flow communication with pilot valve passage 66 via passage 75. The underside of actuator valve 70 comprises a cup-shaped depression which is slidable over valve plate 62. Valve plate 62 has three ports passing therethrough, a center port in flow communication with exhaust chamber 56 via passage 71, and respective outside ports in flow communication with diaphragm air chambers 44, 46. A first passage 76 connects the first outside port in valve plate 62 to diaphragm air chamber 44; a second passage 78 connects the other outside port in valve plate 62 to diaphragm air chamber 46. In the position shown in FIG. 6, actuator valve 70 is positioned to exhaust air from diaphragm air chamber 46 to exhaust chamber 56 by creating an air flow communication path between passage 78 and passage 71. In its alternate position, actuator valve 70 creates an exhaust flow communication path between the passage 76 and the passage 71.

Figure 7:
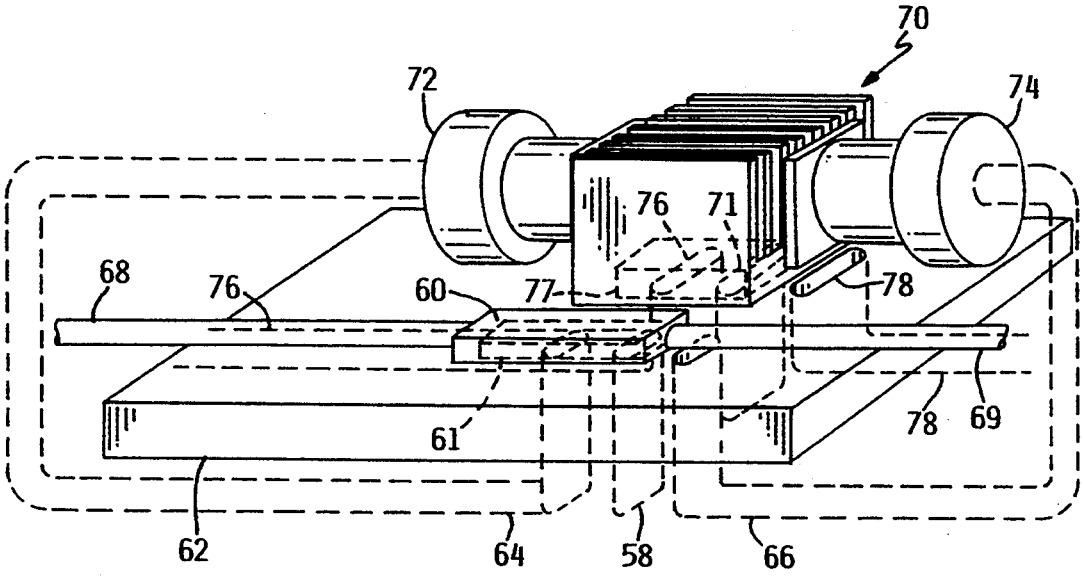
FIG. 7 shows an isometric view of the actuator valve assembly.

The operation of actuator valve 70 and pilot valve 60 are best illustrated in the isometric view of FIG. 7. Pilot valve 60 and actuator valve 70 are formed as slide valves which are slidably movable over valve plate 62. Valve plate 62 has three aligned orifices therethrough for each of the two valves. Pilot valve 60 is slidably moved across the three orifices by actuator pins 68, 69, which in turn are moved by contact with either diaphragm plate 41*b* or diaphragm plate 43*b*. In the position shown in FIG. 7, pilot valve 60, via its cup-shaped undersurface 61, creates air flow communication between passage 64 and passage 58. Passage 66 is opened into actuator chamber 52, and in operation actuator chamber 52 is filled with pressurized air from air inlet 51. Therefore, the pressurized air in actuator chamber 52 freely passes through passage 66, which is in flow communication with piston 74 associated with actuator valve 70. In its alternate position, pilot valve 60 permits air flow communication between passage 58 and passage 66, thereby uncovering passage 64 to the pressurized air within actuator chamber 52. The pressurized air in actuator chamber 52 can therefore pass freely through passage 64 into contact against piston 72 of actuator valve 70. In either of its operable positions, the pilot valve 60 permits one of the passages 64, 66 to communicate with the exhaust passage 58, while at the same time permitting the other passage to receive pressurized air for communication to one of the pistons 72, 74 associated with actuator valve 70.

Actuator valve 70 is also slidable over valve plate 62, and has a cup-shaped undersurface 77 which permits the pressurized air in actuator chamber 52 to communicate via either passage 76 or passage 78 to one of the diaphragm air chambers. In the position shown in FIG. 7, actuator valve 70 is located over the two orifices which provide flow communication between passage 76 and passage 71; passage 71 is the exhaust passage leading to exhaust chamber 56. Therefore, diaphragm air chamber 44 is exhausted via passage 76 to the exhaust air chamber 56, while at the same time diaphragm chamber 46 receives pressurized air via passage 78.

Actuator valve 70 is preferably constructed of several different materials. A valve cup 80 is preferably made from a low-wear, low-coefficient of friction, plastic material; a heat exchanger 82 is preferably made from aluminum or other metallic material having good heat transfer characteristics, and having a plurality of fins for assisting in the heat transfer; the heat exchanger 82 is affixed to the valve cup 80 by an O-ring 81 which compressibly fits between the two parts, and provides an air seal therebetween. The pilot valve 60 is preferably constructed from a low-wear, low-coefficient of friction, plastic material. One type of plastic material which has performed well in the actuator valve 70 and in the pilot valve 60 is made from acetal with teflon fibers.

In operation, the pressurized air is admitted into a first diaphragm air chamber to cause the diaphragm to deflect outwardly, and at the same time to cause the other diaphragm to deflect inwardly. After a predetermined deflection, the inwardly-deflecting diaphragm contacts an actuator pin and causes the pilot valve to slide to a new position over valve plate 62. The pilot valve then permits the flow of pressurized air to a second actuator valve piston, thereby moving the actuator valve to a second position and blocking the flow of pressurized air to the first diaphragm air cylinder while permitting the pressurized air to flow to the second diaphragm chamber. At the same time, the new position of actuator valve 70 permits the first diaphragm air chamber to exhaust to exhaust chamber 56. In this manner, the two diaphragms within pump 10 will continue to cycle for so long as pressurized air is applied to actuator chamber 50, and for so long as the pressure air forces deflecting the respective diaphragms are sufficiently high to overcome the back pressure of the liquid being pumped. During each inward deflection of a diaphragm liquid is drawn into the diaphragm chamber of the inwardly deflecting diaphragm, while at the same time the other diaphragm is forcing liquid from its diaphragm chamber outwardly through its outlet ball check. This pumping process reverses when the diaphragms deflect in the opposite direction, but in each case the liquid passes inwardly to a diaphragm chamber through one of the ball checks 34, 35, and passes outwardly to the delivery manifold via ball checks 38, 39.

Each time the actuator valve 70 reciprocates, it releases the pressurized air in one of the diaphragm chambers to exhaust chamber 56, and from there outwardly through muffler 22. This causes a rapid decompression of the pressurized diaphragm chamber, and a rapid expansion of the air as it passes into exhaust passage 71 and exhaust chamber 56. This rapid air expansion creates a cooling effect, and lowers the temperature of the exhaust passage walls and actuator assembly as the valve operation continues. If the pressurized air has any significant moisture content, this cooling effect can cause the buildup of frost along the surfaces which are closest to the point of air decompression; i.e., the region adjacent exhaust passage 71. Under certain conditions, this frost buildup can become sufficiently severe so as to block the passages and prevent the actuator valve from any further movement. Therefore, actuator valve 70 is constructed with a metallic heat exchanger to pass heat into the exhaust passage region. The heat exchanger is particularly effective, as it is located within the actuator chamber 52, where there exists a rather continuous flow of pressurized air. The pressurized air which is introduced into actuator chamber 52 is relatively warm air, compared to the exhaust air, and therefore the heat from this air can be transferred via the heat exchanger construction of actuator valve 70 to prevent the buildup of frost.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A double-diaphragm pumping apparatus having a pair of axially aligned interconnected diaphragms respectively reciprocable within a diaphragm chamber, the chamber having a liquid pumping section and an air section, comprising:

a) an actuator chamber located intermediate the respective diaphragm chambers, and a pair of slidable pins, each pin extending between the actuator chamber and one of the air sections of a diaphragm chamber and being slidable by contact from the diaphragm;

b) a pilot valve connected to said pair of slidable pins in said actuator chamber;

c) an actuator valve in said actuator chamber, said actuator valve having a pair of slidable piston actuating members, and having heat exchanger vanes affixed thereto;

d) a pair of first air passages coupled between said pilot valve and respective ones of said pair of slidable piston actuating members;

e) a pair of second air passages coupled between said actuator valve and respective ones of said diaphragm chamber air sections;

f) means for introducing pressurized air into said actuator chamber, each of said second air passages being selectively and alternately openable to said actuator chamber by movement of said actuator valve;

g) an air exhaust chamber in said pumping apparatus, and a third passage connected between said pilot valve and said air exhaust chamber, and a fourth passage connected between said actuator valve and said air exhaust chamber;

whereby predetermined positions of said diaphragms causes actuation of said pilot valve, which causes actuation of said actuator valve to direct pressurized air to a corresponding one of said diaphragm chamber air sections, and to exhaust air from the other one of said diaphragm chamber air sections.

2. The apparatus of claim 1, wherein said heat exchanger vanes comprise metallic fins affixed to said actuator valve.

3. The apparatus of claim 1, wherein said actuator valve piston actuating members each further comprise a piston slidable within a cylinder.

4. The apparatus of claim 3, further comprising a removable cover over said actuator chamber.

5. A double-diaphragm pumping apparatus comprising:

a) a housing having a pair of diaphragm chambers aligned along an axis, and having an intermediate housing section;

b) a pair of removable covers, each cover attached to one of said diaphragm chambers, and a flexible diaphragm clamped between each of said covers and said housing;

c) a shaft slidably fitted in said intermediate housing section along said axis, and means for affixing respective ends of said shaft to each of said diaphragms;

d) an actuator valve chamber in said intermediate housing section, and means for conveying pressurized air into said actuator valve chamber;

e) an actuator valve in said actuator valve chamber, comprising a valve cup slidable over a valve plate, said valve plate having three aligned orifices therethrough, including a central orifice connected to an exhaust passage and each of the other orifices connected via passages to respective ones of said diaphragm chambers, and comprising a heat exchanger affixed to said valve cup;

f) a pair of actuator valve control pistons connected to said actuator valve, and control air passages in said housing in flow communication with said control pistons;

g) a pilot valve in said actuator valve chamber, in air flow communication with said control air passages, and having means for responding to predetermined positions of said diaphragms to activate said pair of actuator valve control pistons; and h) an exhaust chamber in said intermediate housing section, and passages connecting said exhaust chamber to said pilot valve and said actuator valve exhaust passage.

6. The apparatus of claim 5, wherein said heat exchanger further comprises a metallic member having a plurality of fins extending into said actuator chamber.

7. The apparatus of claim 6, wherein said plot valve means for responding to predetermined positions of said diaphragms further comprises a pair of pins slidably mounted in said intermediate housing section and having respective first ends projecting into respective diaphragm chambers, and having second ends connected to said pilot valve.

8. The apparatus of claim 7, wherein said pilot valve further comprises a valve cup slidable over said valve plate, said valve plate having three aligned orifices therethrough including a central orifice connected to said exhaust chamber, and each of the other orifices connected to passages leading to said actuator valve control pistons.

9. The apparatus of claim 8, further comprising a muffler connected to said exhaust chamber.

10. The apparatus of claim 5, further comprising an outer chamber in said housing in close proximity to said exhaust chamber, and a flow passage connected between said outer chamber and said actuator valve chamber.

* * * * *